United States Patent [19]

Thompson

[11] Patent Number: 4,627,548

[45] Date of Patent: Dec. 9, 1986

[54] SAFEGUARD FOR SERRATED TWIST-OFF BOTTLE CAP

[76] Inventor: Kenneth H. Thompson, 4613 Saul Rd., Kensington, Md. 20895

[21] Appl. No.: 727,677

[22] Filed: Apr. 26, 1985

[51] Int. Cl.[4] ..... B65D 41/04

[52] U.S. Cl. ..... 215/295

[58] Field of Search ..... 215/295, 305, 328

[56] References Cited

U.S. PATENT DOCUMENTS

| | | | |
|---|---|---|---|
| 2,074,830 | 3/1937 | Conner | 215/295 X |
| 2,394,135 | 2/1946 | Baar | 215/295 |
| 3,410,435 | 11/1968 | Kopczynski | 215/305 |
| 3,514,004 | 5/1970 | Hammersmith | 215/328 |

*Primary Examiner*—Donald F. Norton

*Attorney, Agent, or Firm*—Epstein & Edell

[57] ABSTRACT

Injury to a user's hand when removing a serrated twist-of cap from a container is prevented by a continuous band of gripping material circumscribing the serrations. The band may be a plastic material sprayed or painted onto the cap in liquid form and allowed to dry and adhere to the serrations. Alternatively, the band may be heat-shrunk about the cap periphery. In another embodiment, the band is a resilient plastic cover secured to the cap in a snap-fit engagement by means of an inwardly projecting annular lip arranged to snap over and engage the lower edge of the serrated cap. In the latter embodiment, the cover is provided with projections or ridges positioned and sized to engage corresponding recesses in the serrated cap sidewall. The band is made of a material which will not slip in the user's hand when the band and cap are twisted/turned.

17 Claims, 7 Drawing Figures

SAFEGUARD FOR SERRATED TWIST-OFF BOTTLE CAP

BACKGROUND OF THE INVENTION

1. Technical Field

The present invention relates to container closures and, more particularly, to twist-off caps having serrated peripheries.

2. Discussion of the Prior Art

A common type of container closure is the threaded twist-off cap having a serrated circumferential sidewall which is crimped to the neck of a bottle or other container. Such caps are commonly employed for beer and soft drink bottles as well as other containers, and have the advantage of eliminating the need for bottle openers. This advantage is somewhat mitigated, however, by the fact that the user often experiences pain, and sometimes lacerations, when twisting the cap off the container. The pain and injury result from the serrated cap edge digging into the user's hand as the user grips and twists the cap. Other types of twist-off caps have been devised, but these are generally more expensive than the serrated crimped caps and require more complicated steps in the bottling process assembly line.

OBJECTS AND SUMMARY OF THE INVENTION

It is therefore an object of the present invention to eliminate the pain and injury caused by serrated twist-off container caps during removal of a cap from a container.

It is another object of the present invention to retain the advantages of serrated and crimped threaded twist-off bottle caps while preventing pain and injury to a user as the cap is being removed from a container.

In accordance with the present invention a continuous band of plastic or similar material is disposed circumferentially about the serrated sidewall of the serrated and crimped threaded container cap. The band material has a sufficiently high coefficient of friction to permit the band to be gripped without slippage in a user's hand during removal of the twist-off cap from the container. The band engages the cap serrations so that the cap twists with the band without slippage between the band and cap.

In one embodiment the band is painted, sprayed, injected, etc., about the serrated cap sidewall in liquid form and is then allowed to harden. The resulting band dries while adhering to the serrations and provides a high friction gripping surface to protect the user's hand during cap removal.

In a second embodiment a plastic ring or sleeve is heat shrunk about the serrated sidewall of the cap. The sleeve protects the user's hand while permitting the cap to be twisted with the sleeve.

In a third embodiment of the invention a cap cover is placed over the cap in a snap-fit engagement whereby a bottom annular lip of the cover extends radially inward of the bottom edge of the cap to prevent axial removal of the cover. The cover has a radially inner surface from which ridges project radially inwardly into the recesses of the cap serrations to engage the serrations and cause the cap to turn with the cover relative to the container. The cover has a top wall which resides atop the cap and is preferably annular to permit printed matter on the cap to be seen. The cover material is sufficiently resilient to permit the bottom lip to be spread as the cover is forced onto the cap from above.

Broadly stated, the invention may be described as gripping means in the form of a continuous band disposed circumferentially about a serrated sidewall of a cap, the band having a radially inner surface projecting into the serration recesses. The band has a sufficiently high coefficient of friction to prevent the hand of the user from slipping when turning the band and cap relative to the container.

BRIEF DESCRIPTION OF THE DRAWINGS

The above and still further objects, features and advantages of the present invention will become apparent upon consideration of the following detailed description of specific embodiments thereof, especially when taken in conjunction with the accompanying drawings wherein like reference numerals in the various figures are utilized to designate like components.

DESCRIPTION OF THE PREFERRED EMBODIMENTS

Figure 1:
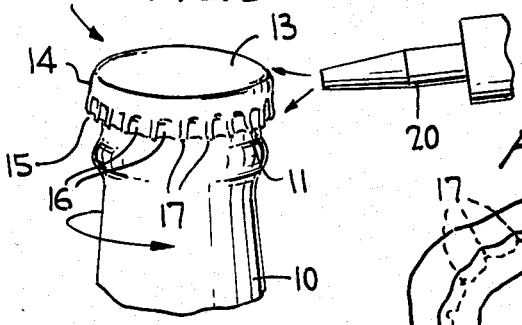
FIG. 1 is a view in perspective of a bottle having a serrated twist-off bottle cap and showing the method of applying a protective coating in accordance with one embodiment of the present invention.
Figure 2:
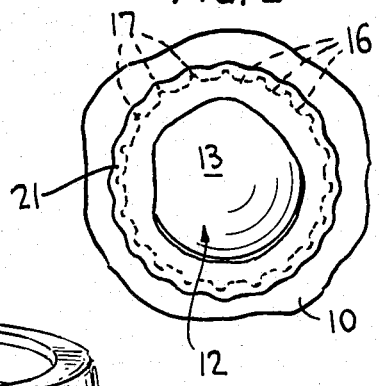
FIG. 2 is a top view in plan of a bottle cap and a safeguard cover applied thereto according to the first embodiment of the present invention.

Referring specifically to FIGS. 1 and 2 of the accompanying drawings, a bottle 10 having a neck 11 has an open end defined by the neck and closed by a cap 12. The cap has a circular top wall 13, a circumferential sidewall 14 depending from the top wall along part of the bottle neck 11, and an annular edge 15 at the lower extremity of sidewall 14. The sidewall is threaded and crimped about threaded neck 11 during the bottling process to define an endless series of serrations in the form of radially inwardly extending recesses 16 alternating with radially outwardly extending protrusions 17. In a typical cap 12 as used for bottles of beer, soda, etc., there are twenty-one such serrations disposed at regular angular intervals about the sidewall.

In the absence of the present invention, cap 12 is removed from bottle 10 by the user grasping sidewall 14, usually between the thumb and forefinger of one hand, and turning the cap counterclockwise (as viewed from above the cap) until the cap is loosened and eventually removed from neck 11 of the bottle. The finger pressure required to sufficiently grasp the cap, combined with the turning force exerted until the crimped cap becomes loose from the bottle neck, causes the protrusions 17 at edge 15 to dig into and irritate the thumb and forefinger of the user. In some cases, the injury is more than a simple irritation and can result in lacerations. The present invention avoids this problem in the manner described below.

Figure 3:
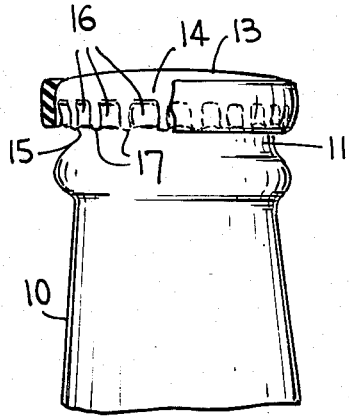
FIG. 3 is a side view in elevation and partial section showing a modification of the embodiment of FIG. 2.

A dispensing nozzle 20 may be placed along a bottling process assembly line at a location subsequent to the crimping of bottle cap 12 onto neck 11. Nozzle 20 dispenses a suitable plastic material in liquid or semi-liquid form onto sidewall 14 to cover the recesses 16 and protrusions 17 of all of the serrations in the sidewall. In order to cover the entire circumferential sidewall, the bottle 10 may be rotated about its axis relative to nozzle 20 as part of the overall process. Alternatively, a bead of the liquid or semi-liquid plastic material may be deposited at one location on the sidewall and then spread or brushed, while still molten, along the entire circumference of the sidewall. The resulting coating band 21 covers all of the recesses 16 and protrusions 17 so that a user's fingers do not contact the protrusions, particularly at edge 15, when the band is grasped and turned to remove cap 12. The coating may cover some or all of the top wall 13 of the cap 12, as illustrated in FIG. 2, or it may be applied only to the sidewall 14, as illustrated in FIG. 3. In either case, the coating adheres to the metal or plastic cap 12 when the coating material dries and hardens after application so that the band 21 does not slip relative to the cap 12 when the band is rotated relative to bottle neck 11. Coating band 21 is preferably made of silicone or polyethylene which can be heated to molten state and which dries and adheres to cap 12 in air at room temperature.

Figure 4:
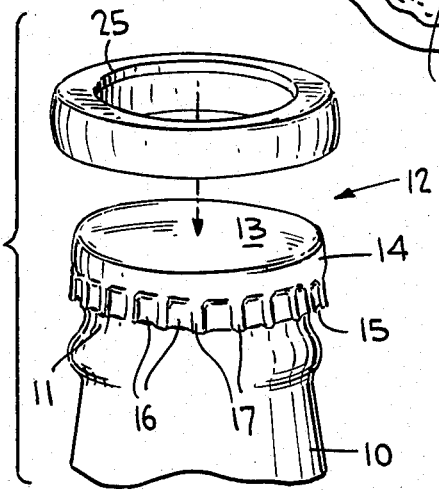
FIG. 4 is an exploded view in perspective of a bottle, bottle cap and safeguard member constructed in accordance with a second embodiment of the present invention.
Figure 5:
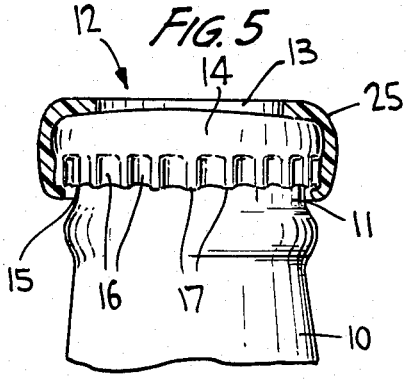
FIG. 5 is a plan view in section of the embodiment of FIG. 4.

An alternative embodiment of the invention is illustrated in FIGS. 4 and 5 and includes a ring 25 of heat-shrinkable plastic material that may be slipped over the bottle cap 12 during the bottling process and heat shrunk over cap sidewall 14 and, preferably, edge 15 to serve as a safeguard or protective sheath. Ring 25 may be shrunk over an annular outer portion of cap topwall 13, as illustrated in the embodiment of FIGS. 4 and 5; alternatively, the ring may be shrunk about sidewall 14 so as not to overlie topwall 13 at all. The important point is that the ring, when heated, shrinks so as to be radially compressed into conformity with the recesses 16 and protrusions 17 of the serrations in sidewall 14. The material of the ring thus projects into the recesses 16 so that the ring cannot slip with respect to cap 12 when the ring is twisted about the central axis of neck 11.

Various heat-shrinkable plastic materials, such as polyvinylchloride (PVC), may be employed for ring 25. A commonly available material for this purpose is a product manufactured by the Markel Corporation and identified as Markel "Flexite Shrinkdown" HT-105 PVC.

Figure 7:
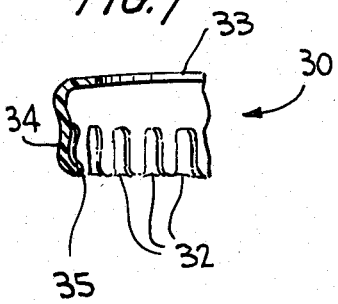
FIG. 7 is a detailed view in section of the safeguard device of the embodiment of FIG. 6.
Figure 6:
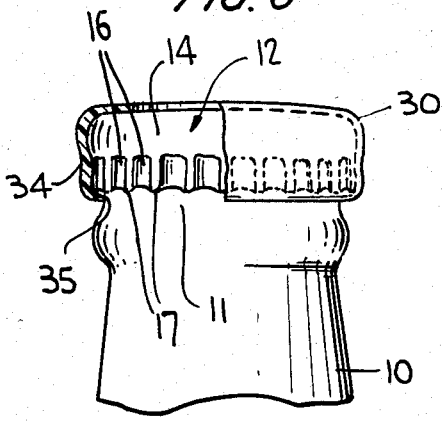
FIG. 6 is a view in elevation and partial section of a bottle, bottle cap and safeguard member constructed in accordance with a third embodiment of the present invention.

Still another embodiment of the present invention is illustrated in FIGS. 6 and 7. A preformed cover 30 for cap 12 is adapted to be secured to the cap in a snap-fit engagement. Cover 30 has a sidewall 34 with an interior surface 31 having an endless series of ridges 32 projecting radially inward. Ridges 32 are spaced and configured to fit into respective recesses 16 of cap 12 when the cover 30 is snapped onto the cap. The cover has a topwall 33 resting on cap topwall 13 when the cover engages the cap. In that position, the lowermost part of cover 30 projects below lower edge 15 of cap 12. A lip 35 at the bottom of cover wall 34 projects radially inwardly toward bottle neck 11 at a location below edge 15 of cap 12 so as to abut edge 15 and preclude inadvertent removal of cover 30 from the cap. The material from which cover 30 is made is sufficiently rcsilient to permit lip 35 to spread as it is forced downwardly over cap 12 and along sidewall 14 until lip 35 clears edge 15 during deployment of the cover on the cap. A suitable material for this purpose is resilient polypropylene, such as product No. 6529 polypropylene manufactured by Himont Plastics Company. The ridges 32 on inner wall 31 project into respective recesses 16 of cap 12 to prevent mutual angular displacement between cover 30 and cap 12 when the cover is twisted to open bottle 10. It is preferred that the number of ridges 32 correspond to the number of recesses 16; however, it will be appreciated that a single such ridge 32 could suffice to prevent rotational slippage between the cover 30 and cap 12.

Lip 35 of cover 30 need only project radially inwardly of edge 15 of cap 12; otherwise, the configuration of the lip can vary considerably. More specifically, the lip can project downwardly and inwardly, upwardly and inwardly, or only inwardly.

The topwall 33 of cover 30 may be annular, as shown, whereby printed matter, relating to the bottled product, appearing on the bottle cap topwall 13 is visible. Alternatively, the topwall 33 may be a solid circle in which case the printed matter relating to the bottled product may appear on the wall 33.

The essence of the present invention is a protective member disposed about the serrated portion of a serrated twist-off bottle cap to prevent injury to a user when twisting off the cap. In all of the embodiments described, the protective member is inexpensive to fabricate and simple to deploy.

Having described preferred embodiments of a new and improved bottle cap cover, it is believed that other modifications, variations and changes will be suggested to those skilled in the art in view of the teachings set forth herein. It is therefore to be understood that all such variations, modifications and changes are believed to fall within the scope of the present invention as defined in the appended claims.

What is claimed is:

1. In combination:

a container having an annular open end defined in a neck portion;

a twist-off cap disposed about said open container end, said twist-off cap having a circumferential sidewall configured as an endless series of serrations in the form of radially outward protrusions alternating with recesses crimped against and in direct contact with said neck portion; and gripping means in the form of a continuous band disposed circumferentially about said sidewall, said band having a radially inner surface projecting into said recesses and entirely covering said protrusions and recesses, said band having a sufficiently high coefficient of friction to prevent the hand of a user from slipping when turning the band and cap relative to the container end, yet being sufficiently smooth to prevent abrasions when sliding along a user's hand.

2. The combination according to claim 1 wherein said cap has a top portion covering said container end and an exposed annular bottom edge displaced axially from said top portion by said circumferential sidewall, said bottom edge including said endless series of recesses and protrusions.

3. The combination according to claim 2 wherein said sidewall tapers radially outwardly toward said bottom edge such that said bottom edge, at said protrusions, is an exposed, sharp and serrated edge.

4. The combination according to claim 3 wherein said band is a coating adhered to said sidewall.

5. The combination according to claim 2 wherein said band is a coating adhered to said sidewall.

6. The combination according to claim 1 wherein said band is a coating adhered to said sidewall.

7. In combination:

a container having an annular open end defined in a neck portion;

a twist-off cap disposed about said open container end, said twist-off cap having a circumferential sidewall configured as an endless series of serrations in the form of radially outward protrusions alternating with recesses crimped against said neck portion; and gripping means in the form of a continuous band disposed circumferentially about said sidewall, said band having a radially inner surface projecting into said recesses and covering said protrusions, said band having a sufficiently high coefficient of friction to prevent the hand of a user from slipping when turning the band and cap relative to the container end, yet being sufficiently smooth to prevent abrasions when sliding along a user's hand;

wherein said cap has a top portion covering said container end and an exposed annular bottom edge displaced axially from said top portion by said circumferential sidewall, said bottom edge including said endless series of recesses and protrusions;

wherein said sidewall tapers radially outwardly toward same bottom edge such that said bottom edge, at said protrusions, is an exposed, sharp and serrated edge; and wherein said band is a plastic sleeve heat-shrunk to be radially compressed about said sidewall.

8. In combination:

a container having an annual open end defined in a neck portion;

a twist-off cap disposed about said open container end, said twist-off cap having a circumferential sidewall configured as an endless series of serrations in the form of radially outward protrusions alternating with recesses crimped against said neck portion; and gripping means in the form of a continuous band disposed circumferentially about said sidewall, said band having a radially inner surface projecting into said recesses and covering said protrusions, said band having a sufficiently high coefficient of friction to prevent the hand of a user from slipping when turning the band and cap relative to the container end, yet being sufficiently smooth to prevent abrasions when sliding along a user's hand;

wherein said cap has a top portion covering said container end and an exposed annular bottom edge displaced axially from said top portion by said circumferential sidewall, said bottom edge including said endless series of recesses and protrusions;

wherein said sidewall tapers radially outwardly toward same bottom edge such that said bottom edge, at said protrusions, is an exposed, sharp and serrated edge; and wherein said band is a pre-formed cover for said cap having an interior surface with a series of spaced ridges disposed in respective recesses of said serrations.

9. The combination according to claim 8 wherein said cover includes means for engaging said cap in a snap-fit engagement.

10. The combination according to claim 9 wherein said cover has a topwall disposed on said top portion of said cap, and a lower edge disposed below said bottom edge of said cap, and wherein said engagement means includes a radially inwardly directed lip on said lower edge of said cover projecting inwardly of and engaging said bottom edge, said cover being sufficiently resilient to permit said lower edge to be radially spread as it is forced axially downward along the cap sidewall until the lower edge of the cover clears the bottom edge of the cap.

11. In combination:

a container having an annular open end defined in a neck portion;

a twist-off cap disposed about said open container end, said twist-off cap having a circumferential sidewall configured as an endless series of serrations in the form of radially outward protrusions alternating with recesses crimped against said neck portion; and gripping means in the form of a continuous band disposed circumferentially about said sidewall, said band having a radially inner surface projecting into said recesses and covering said protrusions, said band having a sufficiently high coefficient of friction to prevent the hand of a user from slipping when turning the band and cap relative to the container end, het being sufficiently smooth to prevent abrasions when sliding along a user's hand;

wherein said cap has a top portion covering said container end and an exposed annular bottom edge displaced axially from said top portion by said curcumferential sidewall, said bottom edge including said endless series of recesses and protrusions; and wherein said band is a plastic sleeve heat-shrunk to be radially compressed about said sidewall.

12. In combination:

a container having an annular open end defined in a neck portion;

a twist-off cap disposed aobut said open container end, said twist-off cap having a circumferential sidewall configured as an endless series of serrations in the form of radially outward protrusions alternating with recesses crimped against said neck portion; and gripping means in the form of a continuous band disposed circumferentially about said sidewall, said band having a radially inner surface projecting into said recesses and covering said protrusions, said band having a sufficiently high coefficient of friction to prevent the hand of a user from slipping when turning the band and cap relative to the container end, yet being sufficiently smooth to prevent abrasions when sliding along a user's hand;

wherein said cap has a top portion covering said container end and an exposed annular bottom edge displaced axially from said top portion by said circumferential sidewall, said bottom edge including said endless series of recesses and protrusions; and wherein said band is a pre-formed cover for said cap having an interior surface with a series of spaced ridges disposed in respective recesses of said serrations.

13. The combination according to claim 12 wherein said cover includes means for engaging said cap in a snap-fit engagement.

14. The combination according to claim 13 wherein said cover has a topwall disposed on said top portion of said cap, and a lower edge disposed below said bottom edge of said cap, and wherein said engagement means includes a radially inwardly directed lip on said lower edge of said cover projecting inwardly of and engaging said bottom edge, said cover being sufficiently resilient to permit said lower edge to be radially spread as it is forced axially downward along the cap sidewall until the lower edge of the cover clears the bottom edge of the cap.

15. In combination:

a container having an annular open end defined in a neck portion;

a twist-off cap disposed about said open container end, said twist-off cap having a circumferential sidewall configured as an endless series of serrations in the form of radially outward protrusions alternating with recesses crimped against said neck portion; and gripping means in the form of a continuous band disposed circumferentially about said sidewall, said band having a radially inner surface projecting into said recesses and covering said protrusions, said band having a sufficiently high coefficient of friction to prevent the hadn of a user from slipping when turning the band and cap relative to the container end, yet being sufficiently smooth to prevent abrasions when sliding along a user's hand;

wherein said band is a plastic sleeve heat-shrunk to be radially compressed about said sidewall.

16. In combination:

a container having an annular open end defined in a neck portion;

a twist-off cap disposed about said open container end, said twist-off cap having a circumferential sidewall configured as an endless series of serrations in the form of radially outward protrusions alternating with recesses crimped against said neck portion; and gripping means in the form of a continuous band disposed circumferentially about said sidewall, said band having a radially inner surface projecting into said recesses and covering said protrusions, said band having a sufficiently high coefficient of friction to prevent the hand of a user from slipping when turning the band and cap relative to the container end, yet being sufficiently smooth to prevent abrasions when sliding along a user's hand;

wherein said band is a pre-formed cover for said cap having an interior surface with a series of spaced ridges disposed in respective recesses of said serrations.

17. In combination:

a container having an annular open end defined in a neck portion;

a twist-off cap disposed about said open container end, said twist-off cap having a circumferential sidewall configured as an endless series of serrations in the form of radially outward protrusions alternating with recesses crimped against said neck portion; and gripping means in the form of a continuous band disposed circumferentially about said sidewall, said band having a radially inner surface projecting into said recesses and covering said protrusions, said band having a sufficiently high coefficient of friction to prevent the hand of a user from slipping when turning the band and cap relative to the container end, yet being sufficiently smooth to prevent abrasions when sliding along a user's hand;

wherein said cover includes means for engaging said cap in a snap-fit engagement.

* * * * *